United States Patent [19]

Kuckhermann

[11] Patent Number: 4,498,894

[45] Date of Patent: Feb. 12, 1985

[54] SEPARATION APPARATUS FOR SEPARATING PERFORATED PAPER TUBE SECTIONS

[75] Inventor: Gustav Kuckhermann, Achern-Oberachern, Fed. Rep. of Germany

[73] Assignee: Icoma Packtechnik GmbH, Achern, Fed. Rep. of Germany

[21] Appl. No.: 500,673

[22] Filed: Jun. 3, 1983

[30] Foreign Application Priority Data

Jun. 3, 1982 [DE] Fed. Rep. of Germany ..... 3220892

[51] Int. Cl.[3] ..... B26F 3/02

[52] U.S. Cl. ..... 493/234; 156/510; 225/100

[58] Field of Search ..... 493/22, 234; 156/510; 225/93, 100

[56] References Cited

U.S. PATENT DOCUMENTS

| | | | |
|---|---|---|---|
| 3,057,527 | 10/1962 | Hannon | 225/100 |
| 3,273,322 | 9/1966 | Fesco | 493/234 X |
| 3,675,542 | 7/1972 | Torigoe | 225/100 X |
| 4,091,978 | 5/1978 | Graham | 225/100 |

*Primary Examiner*—David Simmons

*Attorney, Agent, or Firm*—Pollock, Vande Sande and Priddy

[57] ABSTRACT

An apparatus for separating perforated paper tube sections coming from a paper tube machine consists of a plurality of endless conveyor belts which are disposed above and below the moving paper tube sections. Each conveyor is associated with a plurality of rollers, the rollers above the paper tube section being displaced in relation to those below the paper tube sections. The driving elements for the conveyor belts are located at fixed positions, and to effect separation of the perforated tube sections, the rollers are moved relative to one another for a brief time interval in a direction transverse to the direction of transport of the paper tube sections.

8 Claims, 6 Drawing Figures

SEPARATION APPARATUS FOR SEPARATING PERFORATED PAPER TUBE SECTIONS

BACKGROUND OF THE INVENTION

The present invention comprises an improved apparatus for separating perforated paper tube sections which come from a paper tube machine. The invention has a forward pulling station with circulating conveyor elements and a separating station consisting of leading rotating tearing elements which lie opposite each other and can be adjusted counter to each other.

In well-known apparatuses of this kind, the forward pulling station has roller shaped forward-pulling members located above the paper tube and forward-pulling members below the paper tube. If the paper tubes are provided with side folds, the forward-pulling members engage the paper tube only in the area of the side folds where there are twice the number of paper layers. To assure that transverse gluings on the paper tube section are not squeezed out, the forward pulling members must be briefly lifted up in the area of the transverse gluings. The forward-pulling stations are repeatedly arranged behind each other so that, also by lifting, the forward movement of the paper tube can be effected.

In these known apparatuses, the forward-pulling members leave impressions on the paper tube and they especially affect the quality of the paper tube when elastic papers are being processed.

Separation stations in use today have a retaining cylinder and a separating cylinder. In the case of paper tubes for side folding bags, rollers having a greater diameter must be used for the area between the side folds, or a second separating cylinder is required for the area between the side folds. Because the bodies of the separating cylinders have to be pressed firmly against each other for a short time, impressions also occur on the paper tube sections at the separating station.

Because the separating bodies at the separating station must, for a short time, be moved toward each other and then away from each other in the opposite direction, it is necessary to construct the driving wheels in such a way that their location can be changed. This is presently achieved with the help of drive shafts and universal joints, which make the transport system very expensive.

SUMMARY OF THE INVENTION

It is the purpose of this invention to provide a separating apparatus of the general type described above which, however, allows for gentle handling of the paper tube sections, is simple in construction, and requires no or minimal adjustments when changing paper tube formats, types, or qualities.

The foregoing advantages are achieved according to the invention, by the use of circulating, endless conveyor belts and associated rollers in the forward pulling and separation stations, the rollers on the underside of the paper tube sections in each such station being displaced longitudinally along the paper tube in relation to the rollers above the paper tube. Providing conveyor belts with displaced rollers allows the processing of varying paper tube formats, varying paper tube types (for example with or without side folds), and also varying paper qualities. In contrast to the prior art apparatus, wherein a difference in thickness between the edge area and the middle area in paper tubes with side folds always requires a changing of the separating bodies in the middle area, the new arrangement does not require such adjustments. The provision of the aforementioned conveyor belts and the associated arrangement of the rollers automatically compensates for varying thicknesses across the whole width of the paper tube.

BRIEF DESCRIPTION OF THE DRAWINGS

Preferred arrangements of the invention will be described in conjunction with the accompanying drawings, wherein.

DESCRIPTION OF THE PREFERRED EMBODIMENTS

Figure 4:
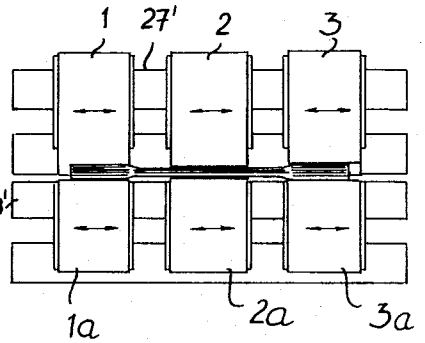
FIG. 4 is a front view, from the left, of the FIG. 2 embodiment.
Figure 2:
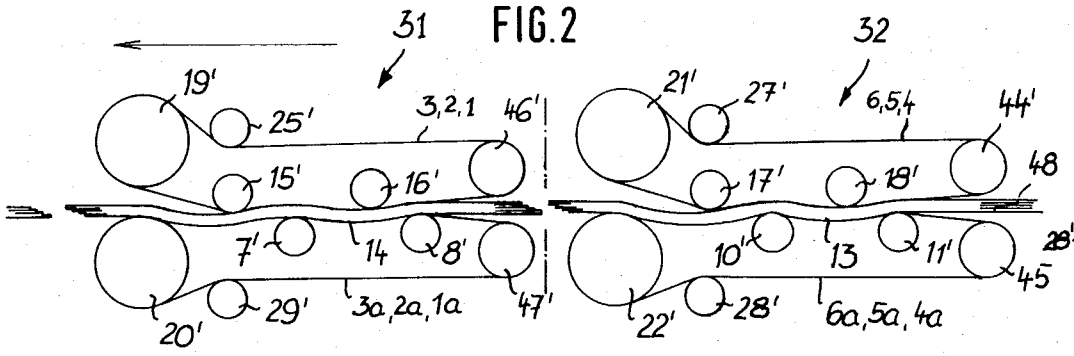
FIG. 2 is a schematic side view representation of a first embodiment of the invention.
Figure 3:
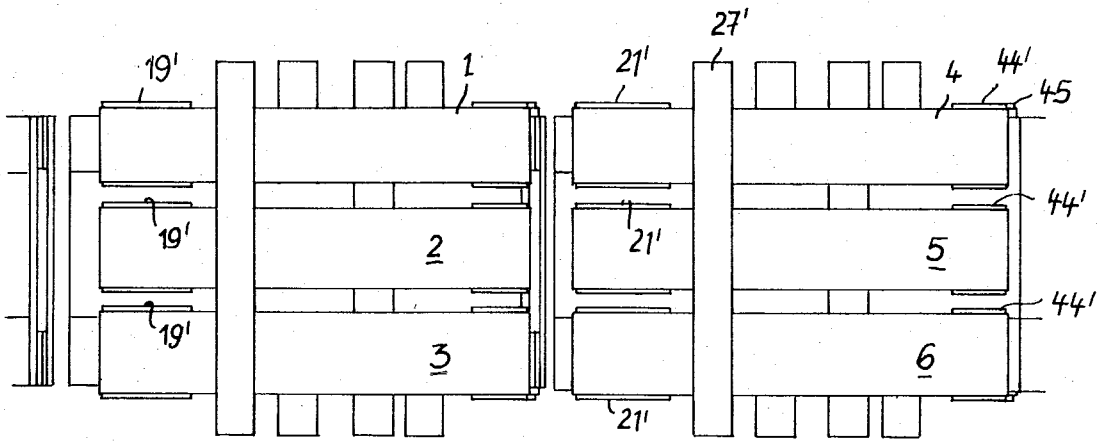
FIG. 3 is a schematic top view of the arrangement shown in FIG. 2.

The two embodiments of the present invention according to FIGS. 2 to 4 on the one hand, and according to 5 and 6 on the other hand, are not different in principle, but merely in regard to construction. Therefore, in both embodiments the equivalent parts are designated respectively by the same reference numbers, the parts in the two embodiments being differentiated from one another by a prime designation.

Figure 1:
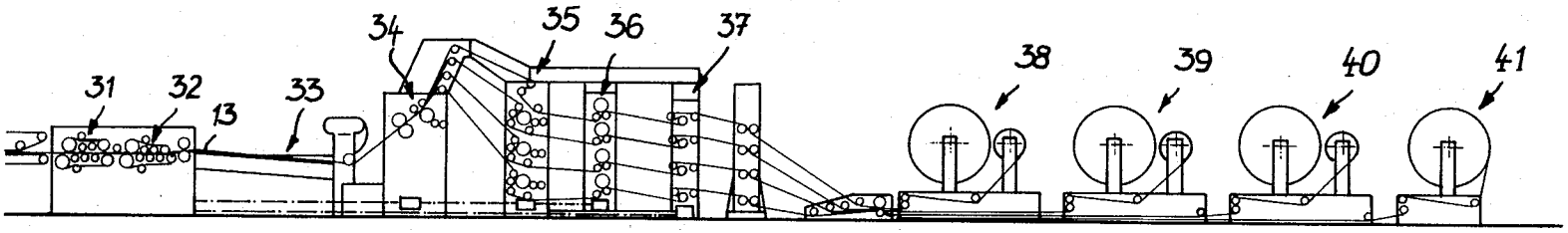
FIG. 1 is a schematic representation of a paper tube machine with a separation apparatus according to the invention.

The paper tube machine represented in FIG. 1 has four roll supply stations 38, 39, 40 and 41 from which four layers of paper can be rolled off and combined to form a paper tube. The rolled off layers are pulled over a forward pulling loop 37 and are led to a perforating station 36. At the perforating station 36, the single layers are perforated transverse to the running direction. Thereafter, the individual paper layers run through a transverse gluing station 35 and a longitudinal gluing station 34. The desired paper tube is then formed in a tube formation apparatus 33. The formed paper tube runs through a forward pulling station 32 and then passes to a separating station 31.

The separating station 31 comprises an apparatus which runs more quickly than the forward pulling station 32. The station 31 includes conveyor belts which are controlled in such a way that they strongly grasp one of the paper tube sections 14 (compare FIG. 2) in a synchronized manner and pull forward when the perforated line in the tube sections lies between the said paper tube section 14 and an adjacent paper tube section 13 or, in other words, when the perforated line in the tube sections is between the forward pulling station 32 and the separating station 31. Paper tube section 14 is torn away from paper tube section 13 along the perforated line due to the greater speed of the conveyor belts in the separating station 31.

Referring now to the embodiments shown in FIGS. 2 to 4:

The paper tube section 13 arrives at the forward pulling station 32. The forward pulling station 32 has three parallel endless conveyor belts 4, 5 and 6 positioned above the paper tube section 13 as well as three endless conveyor belts 4*a*, 5*a* and 6*a* arranged next to each other below the paper tube section 13. The upper conveyor belts 4–6 are driven by three driving rollers 21' and run around three guide rollers 44' which lie next to each other. Below the paper tube section 13 are three further driving rollers 22' arranged next to each other, and three guide rollers 45' also arranged next to each other, for the lower conveyor belts 4*a*, 5*a* and 6*a*. The upper and lower conveyor belts are stretched over tension rollers 27' and 28' respectively.

Below the paper tube section 13, rollers 10' and 11' are provided for the lower conveyor belts 4*a*, 5*a* and 6*a*, which push the lower conveyor belts upwardly against the lower side of paper tube section 13. Above the paper tube section 13, additional rollers 17' and 18' press the conveyor belts 4–6 downwardly against the upper side of paper tube section 13. The rollers 17' and 18' are set longitudinally across from and parallel to the rollers 10' and 11', but the two sets of rollers are not directly across from each other. This displaced arrangement of the upper and lower rollers results in a serpentine path through which the paper tube section 13 snakes between the rollers. With this arrangement, it is possible to transport a paper tube which varies in thickness across its width, without having to adjust the vertical spacing between the upper and lower transport elements. Compensation for differences in thickness between the thicker side folds and the middle area of the paper tube section is effected automatically.

The construction of the separating station 31 is generally similar to the construction of the forward pulling station 32 described above. More particularly, it comprises three endless conveyor belts 1, 2 and 3 running next to each other above paper tube section 14, and three further endless conveyor belts 1*a*, 2*a* and 3*a*, also running next to each other, below paper tube section 14. The three driving rollers (which lie next to each other) for the upper conveyor belts are designated 19', while the three driving rollers (again next to each other) for the three lower conveyor belts are designated 20'. The tension rollers are designated 25' and 29'. The lower rollers 7' and 8' push the conveyor belts 1*a*, 2*a* and 3*a* upwardly against the bottom side of the paper tube section 14 while the rollers 15' and 16' push the conveyor belts 1, 2, 3 downwardly against the top side of the paper tube section 14. The separating point between the paper tube section 13 and the paper tube section 14 is designated 48. The guide rollers for the upper conveyor belts 1 through 3 are designated 46' and the lower guide rollers are designated 47'.

Figure 5:
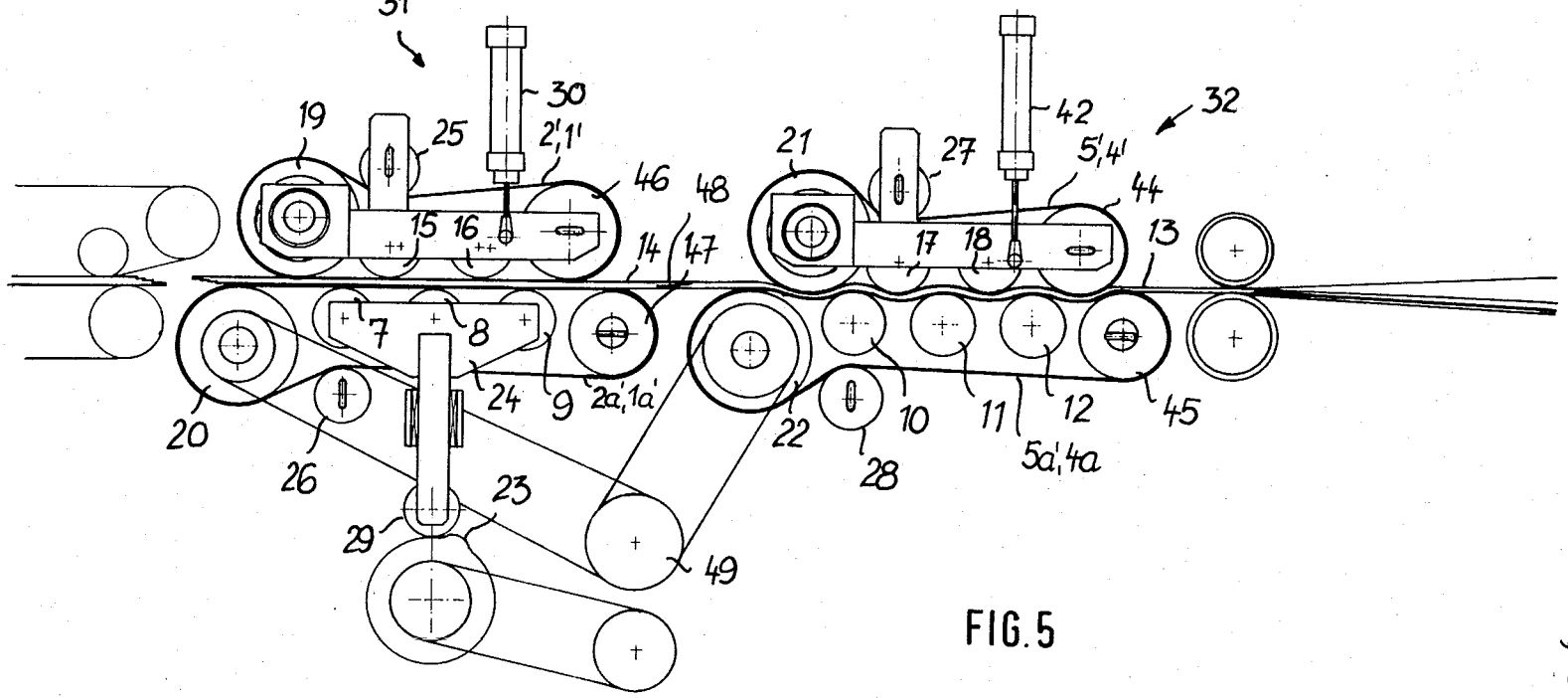
FIG. 5 is a side view of a second embodiment of the invention.
Figure 6:
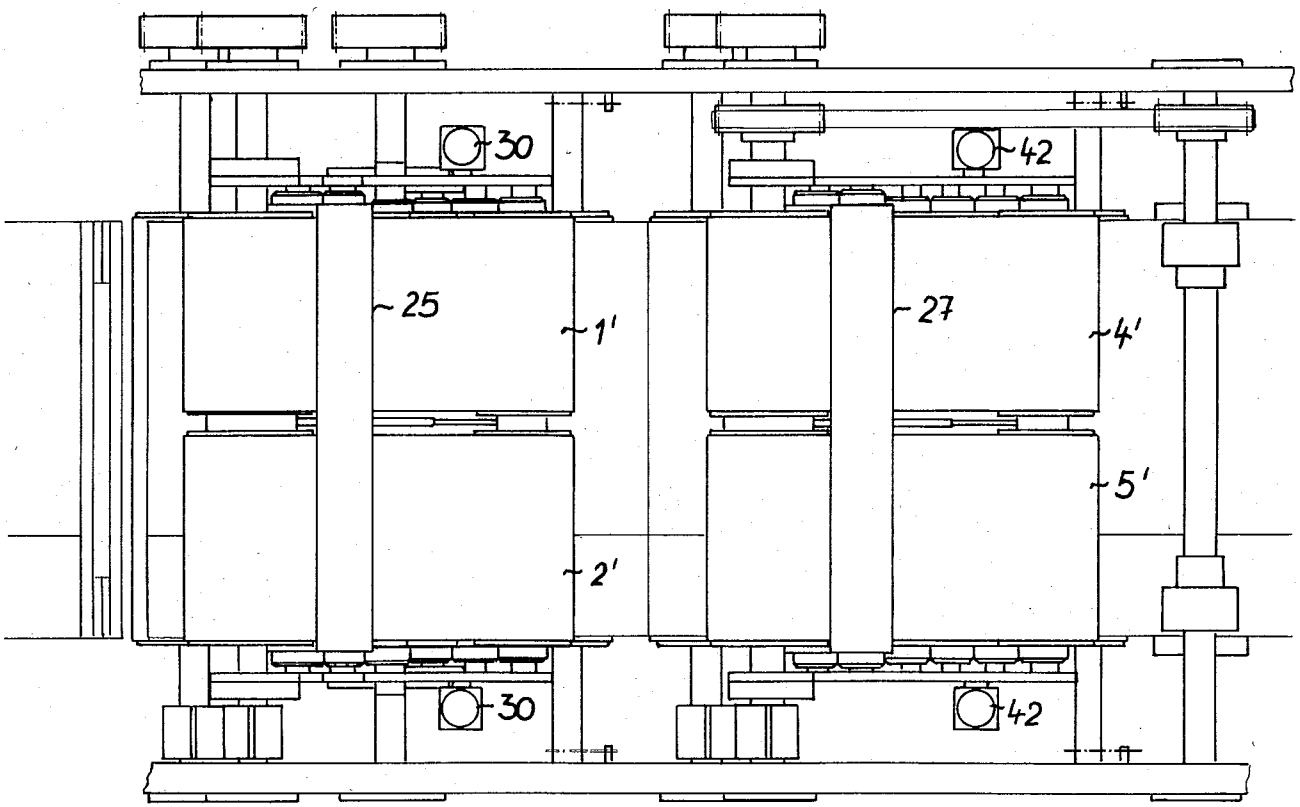
FIG. 6 is a top view of the embodiment shown in FIG. 5.

The method/mode of operation of the separation apparatus is best described by reference to the more detailed embodiment of the invention shown in FIGS. 5 and 6 wherein parts which correspond to the embodiment of FIGS. 2–4 are designated by the same reference numbers. In the embodiment of FIGS. 5 and 6, however, only two conveyor belts are provided on the upper and lower sides of the forward pulling station and of the separating station, and the lower conveyors in the two stations run over three rollers (rather than over two rollers, as in FIG. 2) which are arranged between the driving rollers and the guide rollers.

In the forward pulling station 32 two conveyor belts 4' and 5' lie next to each other on the top side of the station, and two further conveyor belts 4*a'* and 5*a'* lie next to each other on the bottom side.

In the separating station 31 the two upper conveyor belts which are next to each other are marked 1' and 2', while the two lower conveyor belts which lie next to each other are marked 1*a'* and 2*a'*.

The conveyor belts 4' and 5' as well as 4*a'* and 5*a'* constantly and strongly grip the paper tube section 13 and pull it forward. The rollers 17 and 18, which engage upper conveyor belts 4', 5' and press the said belts downwardly, can be adjusted in height relative to rollers 10–12 associated with lower conveyor belts 4*a'*, 5*a'*, by means of an adjusting apparatus 42. Furthermore, it is possible to effect adjustment of the guide rollers 44 and 45 in a longitudinal direction and adjustment of the tension rollers 27 and 28 transverse to the longitudinal direction.

In similar fashion, the construction of separating station 31 is such that the vertical position of the rollers 15 and 16 can be adjusted by means of adjusting apparatus 30; the tension rollers 25 and 26 can be transversely adjusted to the conveying direction; and the guide rollers 46 and 47 are adjustable along the length of the paper tube.

The lower rollers 7, 8 and 9 in separating station 31 sit in a support 24 which can be moved in a direction transverse to the conveying direction. The support 24 is so mounted that it can be moved in a direction transverse to the tube plane, and carries under it at its lower end a roller 29. This roller 29 runs against a disc that is provided with a cam 23. The turning motion of the disc with the cam 23 is coordinated in such a way with the forward motion of the paper tube that a lifting of the support 24 and thereby a movement of the rollers 7 through 9 in the direction of the opposite rollers follows when the perforation 48 lies between forward pulling station 32 and the separating station 31. This upward movement of the support 24 and of the rollers 7 through 9 causes the paper tube section 14 to be firmly grasped between the upper and lower conveyor belts. Because the conveyor belts of the separating station 31 run more quickly than the conveyor belts of station 32, a separation of the paper tube section at the perforation 48 is effected. Thereafter the support is immediately lowered and the separated paper tube section 14 is transported on to the left.

A common drive 49 serves as a motive power for the drive rollers 20 and 22 which run at different speeds in relation to each other. It is also possible to couple the lower drive rollers to their respective upper drive rollers at each station, i.e., 20 to 19 and 22 to 21, since the drive rollers are mounted in fixed positions relative to one another.

Having thus described my invention, I claim:

1. In a paper making machine of the type operative to produce an elongated paper tube consisting of a plurality of successive paper tube sections which are demarcated from one another by perforations in said tube, said machine including a forward pulling station for transporting said paper tube out of said machine and further including a separating station for separating said paper tube sections from one another at said perforations, the improvement wherein said forward pulling station comprises first endless conveyor belt means located above said elongated paper tube and second endless conveyor belt means located below said elongated paper tube, a first plurality of rollers in engagement with portions of said first conveyor belt means for urging said portions of said first conveyor belt means toward one side of said tube, a second plurality of rollers in engagement with portions of said second conveyor belt means for urging said portions of said second conveyor belt means toward the other side of said tube, the rollers in said first plurality of rollers being displaced, in the direction of movement of said paper tube, from the rollers in said second plurality of rollers whereby said paper tube follows a serpentine path of movement and it travels between said first and second endless conveyor belt means, said separating station being located downstream of said forward pulling station and comprising third and fourth endless conveyor belt means located above and below said elongated paper tube respectively, third and fourth pluralities of rollers in engagement with portions of said third and fourth conveyor belt means respectively, the rollers in said third plurality of rollers being displaced, in the direction of movement of said paper tube, from the rollers in said fourth plurality of rollers, and drive means coupled to the conveyor belt means in said forward pulling station and in said separating station, said drive means being operative to cause the conveyor belt means in said separating station to move at a greater transport speed than the conveyor belt means in said forward pulling station.

2. The apparatus of claim 1 wherein said drive means comprises drive rollers mounted at fixed positions relative to one another in engagement with each of said conveyor belt means, said first, second, third and fourth pluralities of rollers being mounted for free rotation adjacent their associated conveyor belt means.

3. The apparatus of claims 1 or 2 including adjusting means for moving said third and fourth pluralities of rollers toward and away from one another in a direction transverse to the direction of movement of said paper tube to cause said third and fourth conveyor belt means to grasp and thereafter to release a paper tube section therebetween.

4. The apparatus of claim 3 wherein said adjusting means comprises cam means operative at a rate related to the speed of movement of said paper tube through said forward pulling station for periodically moving said third and fourth pluralities of rollers toward one another for a brief time interval.

5. The apparatus of claim 4 wherein said cam means effects said movement of said third and fourth pluralities of rollers toward one another when the perforations between a successive pair of paper tube sections are disposed between said forward pulling station and said separating station.

6. The apparatus of claim 4 wherein the rollers in one of said third and fourth pluralities of rollers are mounted in spaced relation to one another in a common support structure, said cam means being operative to effect movement of said common support structure in a direction transverse to the direction of movement of said paper tube.

7. The apparatus of claim 1 wherein said drive means comprises drive rollers mounted at fixed positions relative to one another in engagement respectively with said conveyor belt means, said conveyor belt means being guided over guide rollers, and means for selectively adjusting the positions of at least some of said guide rollers relative to said drive rollers in a direction parallel to the direction of movement of said paper tube.

8. The apparatus of claims 1, 2 or 7 wherein at least some of said conveyor belt means comprises a plurality of separate endless conveyor belts disposed in side by side relation to one another across the width of said elongated paper tube.

* * * * *